US005299807A

United States Patent [19]

Hutin

[11] Patent Number: 5,299,807

[45] Date of Patent: Apr. 5, 1994

[54] GOLF CLUB HEAD

[75] Inventor: Patrice Hutin, Annecy Le Vieux, France

[73] Assignee: Skis Rossignol S.A., France

[21] Appl. No.: 933,302

[22] Filed: Aug. 21, 1992

[30] Foreign Application Priority Data

Aug. 28, 1991 [FR] France ..... 91 10848

[51] Int. Cl.[5] ..... A63B 53/04

[52] U.S. Cl. ..... 273/173; 273/78; 273/167 J

[58] Field of Search ..... 273/78, 167 BJ, 173, 273/167 R, 169, 171, 167 F, 167 H

[56] References Cited

U.S. PATENT DOCUMENTS

| | | | |
|---|---|---|---|
| 1,968,627 | 7/1934 | Young | 273/78 |
| 2,034,936 | 3/1936 | Barnhart | 273/78 |
| 3,567,228 | 3/1971 | Lynn | 273/78 |
| 3,975,023 | 8/1976 | Inamori | 273/78 |
| 4,627,635 | 12/1986 | Koleda | 273/755 |
| 4,884,812 | 12/1989 | Nagasaki et al. | 273/78 |
| 5,083,778 | 1/1992 | Douglass | 273/173 |
| 5,106,094 | 4/1992 | Desbiolles et al. | 273/173 |

*Primary Examiner*—Vincent Millin
*Assistant Examiner*—Steven B. Wong
*Attorney, Agent, or Firm*—Parkhurst, Wendel & Rossi

[57] ABSTRACT

A golf club head comprising a body 2, 30 with a face 3, 33 to which is mounted a striking plate 4, 31 and a thin, visco-elastic sheet 10, 32 sandwiched between the strike plate 4, 31 and the corresponding face 3, 33 of the body.

10 Claims, 2 Drawing Sheets

GOLF CLUB HEAD

BACKGROUND OF THE INVENTION

The present invention concerns a novel golf club head.

It is known that a golf club head, whether a wood, an iron or a putter, comprises a body typically having a metallic surface. This striking surface may be affixed to the clubs called woods by screw means, welding or the like.

Whether a wood, an iron or a putter, the body and the striking plate or surface may be of different or of identical materials, or may even be integral.

U.S. Pat. No. 4,884,812 proposes sandwiching a thick elastic strip between the striking plate and the body of an iron to enhance kinetic-energy transmission to the ball during the striking action. On one hand this design suffers the drawback of absorbing the impact-generated energy as a consequence of which there is a drop in the initial ball speed and hence a drop in efficiency, as well as a loss of accuracy And, on the other hand it suffers the drawback of local and definitive impact deformation of the striking plate.

U.S. Pat. Nos. 2,034,936 and 3,975,023 also disclose a resilient rubber or plastic layer of substantial thickness inserted between the club head body and the striking plate. However, those designs also incur the same drawbacks stated above.

OBJECTS OF THE INVENTION

The objects of the invention are to overcome the aforementioned drawbacks. The invention relates to a golf club head which, while retaining the distance performance achieved with a conventional head and the same feel for the player, does reduce the distortions from off-center impacts and thereby is more forgiving to amateurs, without reducing the striking force.

BRIEF SUMMARY OF THE INVENTION

The inventive club head comprises a body with a face onto which is mounted a striking plate with an elastic layer sandwiched between the striking plate and the body face, wherein the sandwiched elastic layer is a thin, visco-elastic sheet between 0.1 and 0.5 mm thick and with an ambient temperature damping factor between 0.4 and 1.2.

BRIEF DESCRIPTION OF THE DRAWINGS

Other objects and further features of the advantageous golf club head of the present invention are described in conjunction with the accompanying drawings of preferred embodiments of the invention, as follows.

DETAILED DESCRIPTION

Figure 1:
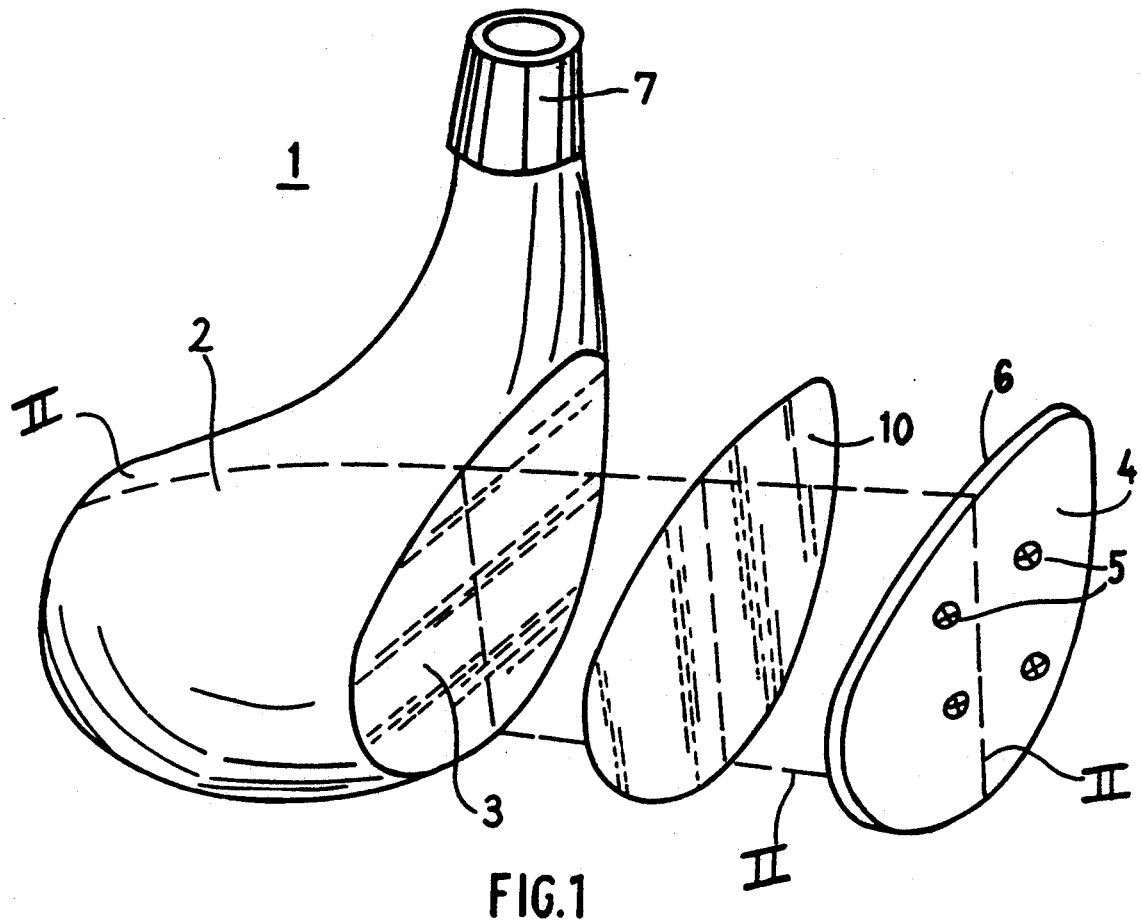
FIG. 1 is a partially-schematic, exploded perspective view of a wood golf club head of the present invention.
Figure 2:
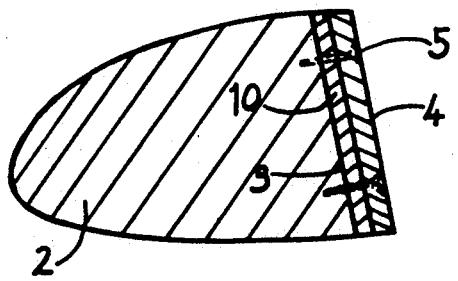
FIG. 2 is a partially schematic, cross-sectional view of the wood club head taken along plane II in FIG. 1.

In FIG. 1, the wood head is denoted by the general reference 1 and comprises a body 2 which typically is made of wood, resin or metal and is connected to a shaft (not illustrated) and may include a collar 7. The top of body 2 is substantially planar, more or less sloping face 3 receiving the metal striking plate 4 which is affixed by any known means, such as screws 5, bonding or the like, to the body 2.

The striking plate 4 is made of a known material, preferably metal, and typically is horizontally grooved in a known manner.

Figure 3:
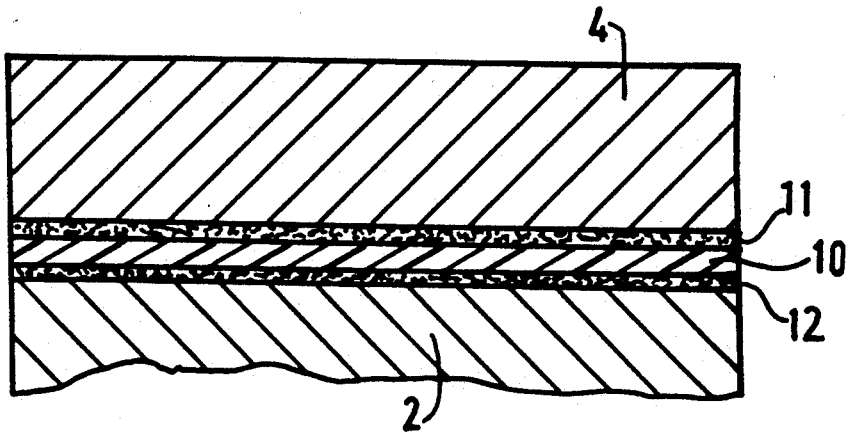
FIG. 3 is an enlarged, more detailed cross-sectional view of the striking plate structure illustrated in FIG. 2.

According to the invention as illustrated in more detail in FIG. 3, a visco-elastic sheet 10, illustratively a 0.3 mm visco-elastic sheet coated on both sides 11, 12 with a fine acrylic adhesive layer about 0.1 mm in thickness, such as that marketed by 3M as ISO 112 or 113, is sandwiched between the front planar face 3 and the rear face 6 of the striking plate 4. The damping factor at 25° C., which usually is called the tangent $\delta$, is between 0.4 and 1.2, and preferably between 0.6 and 0.8.

In practice, the sheet 10 is bonded by its side 12 onto the planar face 3 of the body 2 of the wood golf club head 1, and then the reverse side 6 of the striking plate 4 is applied in contact with the other, external adhesive side 11.

It is known that a visco-elastic material reduces the amplitude of vibration by degrading part of the energy of deformation into heat. Visco-elastic shock absorbers are characterized mainly by a low Young's modulus and a high damping factor, and are widely used in aeronautics, automobiles and in skis. Accordingly they need not be described in detail herein. The essential feature of the visco-elastic material used in the present invention is the intrinsic damping factor between 0.4 and 1.2. Beyond 1.2, the energy from the impact of the ball is excessively absorbed, and hence efficiency drops. Below 0.4, the viscosity effect is negligible. As already stated, the visco-elastic materials used exhibit their optimal properties at the temperatures at which golf clubs are typically used, in particular near ambient temperature.

It has been found that a visco-elastic sheet must be less than 0.5 mm thick and preferably be between 0.1 and 0.5 mm thick. If the thickness is less than 0.1 mm, the effects are vanishingly small. On the other hand, if the thickness exceeds 0.5 mm, there is loss in efficiency, and moreover surface degradation is caused by impact of golf balls. Good results are achieved with a sheet about 0.3 mm thick.

Readily available visco-elastic materials, such as those employed in skis, may be used. Among these materials are butyl rubber and other synthetic elastomers, whether alone, in mixture or with fillers.

Advantageously the characteristic visco-elastic sheet is adhered to the striking plate and the corresponding body face by adhesive layers. In practice, the visco-elastic sheet is made adhesive on both sides so it can be conveniently applied to the external body face and to the internal side of the striking plate.

Whereas in general the sheet 10 is of substantially constant thickness, for instance about 0.3 mm, this sheet also may comprise a stack of finer visco-elastic sheets of which the optimal damping properties are temperature-offset for a given vibration frequency or are frequency-offset for a given temperature. As an illustration, one visco-elastic sheet may exhibit a maximum damping factor at 15° C., and another a maximum damping factor at 30° C., as a result of which the damping factor of the stacking assembly should be a maximum or close to a maximum over a more extended temperature range matching the temperature range in which golf clubs are typically used.

Figure 4:
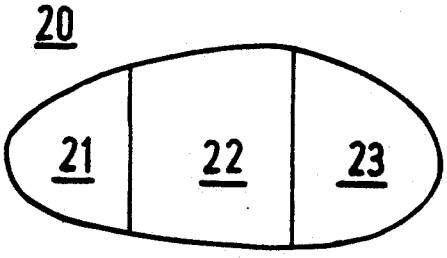
FIG. 4 and FIG. 5 schematically illustrate two embodiments of the visco-elastic sheet member of the present invention.

In FIG. 4, the characteristic visco-elastic sheet 20 comprises a juxtaposition of zones 21, 22, 23 each with optimal damping properties which are temperature-offset for a given frequency of vibration, for instance being identical at the ends 21, 23 and different at the center 22.

Figure 5:
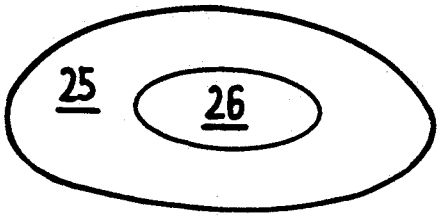

In the embodiment shown in FIG. 5, the two zones 25, 25 are coaxial, and the central zone 26 may not include any visco-elastic material.

Figure 6:
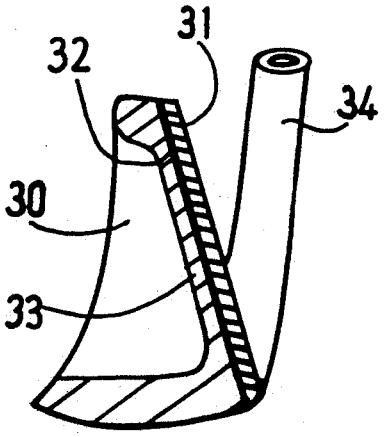
FIG. 6 is a partially schematic, cross-sectional view of a composite iron golf club head of the present invention.

FIG. 6 shows a composite iron of the present invention which comprises a composite body 30 with a striking plate 31 at its face. In the invention a fine sheet about 0.3 mm in thickness, of the same visco-elastic material 32 as in FIG. 1, is sandwiched between the front face 33 of the body 30 and the striking plate 31. On the side at the heel of the club head, the iron comprises a hosel 34 to connect it to a shaft.

Though as a rule the sheet thickness is constant, nevertheless this thickness also may be variable, for instance being concave, convex or even progressive like a wedge.

Figure 7:
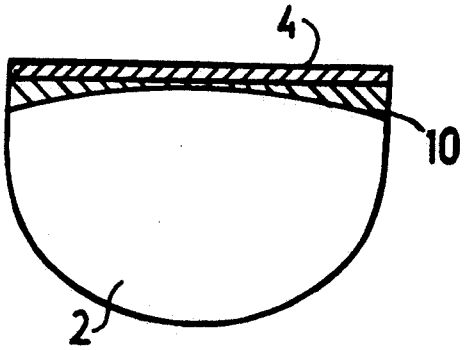
FIG. 7 is a partially schematic cross-sectional of a golf club head of the present invention comprising a visco-elastic sheet sandwiched between a schematic wood body and a metal striking plate, the visco-elastic sheet being of variable thickness, thinner at the center than at the ends.

It is also possible to use a sheet of varying thickness, so that the thickness may be in the rang provided by the invention near the center of percussion and of greater thickness away from said center of percussion. See FIG. 7. In this case an off-center impact with a golf ball would be less powerful and therefore less penalty in trajectory error would be incurred.

Thanks to the presence of the desirable visco-elastic sandwiched sheet, the golf clubs of the present invention offer many advantages over those which have been marketed to date. In particular, this design does not suffer any loss in driving distance, even if the hit or impact is off-center. The feel experienced by the player during striking of the ball remains unchanged, accordingly the player retains his/her striking mastery. Additionally, improved absorption of the vibrations generated by striking the ball is achieved, ensuring player comfort.

The present invention has been found to be particularly well suited to the manufacture of woods having metal striking plates.

What is claimed is:

1. A golf club head comprising a body having a substantially planar clubface surface, a grooved striking plate affixed to the clubface surface, and an elastic layer between the clubface surface and the striking plate, said elastic layer being a visco-elastic sheet having a thickness in the range of 0.1 to 0.5 mm and an ambient temperature damping factor in the range of 0.4 to 1.2.

2. The golf club head of claim 1, wherein the striking plate, elastic layer and clubface surface, respectively are affixed to each other with adhesive.

3. The golf club head of claim 1, wherein the visco-elastic sheet is of substantially uniform thickness throughout its area.

4. The golf club head of claim 1, wherein the thickness of the visco-elastic sheet varies in different portions of its area.

5. The golf club head of claim 1, wherein the body comprises wood.

6. The golf club head of claim 1, wherein the body comprises metal.

7. The golf club head of claim 1, wherein the thickness of the visco-elastic sheet is less than that of the grooved striking plate.

8. A golf club head comprising a body having a substantially planar clubface surface, a grooved striking plate affixed to the clubface surface, and an elastic layer comprising a stack of a plurality of visco-elastic sheets having different damping properties which are at least one of (i) temperature offset for a given vibration frequency and (ii) vibration frequency offset for a given temperature, said stack having a thickness in the range of 0.1 to 0.5 mm and an ambient temperature damping factor in the range of 0.4 to 1.2.

9. A golf club head comprising a body having a substantially planar clubface, a grooved striking plate affixed to the clubface surface, and an elastic layer between the club face surface and the striking plate, said elastic layer being a visco-elastic sheet comprising a plurality of adjacent zones, at least one of said zones having different damping properties, said sheet having a thickness in the range of 0.1 to 0.5 mm and an ambient temperature damping factor in the range of 0.4 to 1.2.

10. The golf club head of claim 9, wherein at least some of said zones have different damping properties which are at least one of (i) temperature offset at a given vibrating frequency and (ii) vibration frequency offset at a given temperature.

* * * * *